United States Patent [19]

Schulzen et al.

[11] Patent Number: 4,681,034

[45] Date of Patent: Jul. 21, 1987

[54] PROCESS FOR PRINTING A SUBSTRATE BY THE HOT-TRANSFER PRINTING METHOD

[76] Inventors: Herbert Schulzen, Wilhelmstr. 33, 6208 Bad Schwalbach 3; Wolfgang Köhler, Westring 55, Weiterstadt 2; Kurt Schliessmann, Pfarrstr. 20, 6054 Obertshausen, all of Fed. Rep. of Germany

[21] Appl. No.: 829,469

[22] Filed: Feb. 13, 1986

Related U.S. Application Data

[63] Continuation of Ser. No. 759,509, Jul. 26, 1985, abandoned, which is a continuation of Ser. No. 591,032, Mar. 19, 1984, abandoned.

[30] Foreign Application Priority Data

Mar. 21, 1983 [DE] Fed. Rep. of Germany ..... 3310120

[51] Int. Cl.[4] ..... B41M 3/00; B41M 1/30; B41M 1/40

[52] U.S. Cl. ..... 101/211; 101/38 A

[58] Field of Search ..... 101/211, 467, 470, 426, 101/35–41; 156/240, 272.2, 272.8; 219/121 L, 121 LA, 121 LE, 121 LQ, 121 LM

[56] References Cited

U.S. PATENT DOCUMENTS

| | | | |
|---|---|---|---|
| 3,280,735 | 10/1966 | Clark | 219/121 L |
| 3,363,557 | 1/1968 | Blake | 101/470 |
| 3,484,342 | 12/1969 | Blake | 204/18 |
| 3,663,155 | 5/1972 | Gray | 8/4 |
| 3,780,214 | 12/1973 | Bestenreiner | 178/5.2 R |
| 3,962,513 | 6/1976 | Eames | 101/470 |
| 3,964,389 | 6/1976 | Peterson | 101/467 |
| 4,032,691 | 6/1977 | Kido | 428/304 |
| 4,245,003 | 1/1981 | Oransky | 428/323 |
| 4,271,347 | 6/1981 | Svenson | 219/121 LQ |
| 4,388,517 | 6/1983 | Schulte | 219/121 LM |

FOREIGN PATENT DOCUMENTS

| | | | |
|---|---|---|---|
| 0001068 | 3/1979 | European Pat. Off. | 101/467 |
| 14901 | 6/1984 | European Pat. Off. . | |
| 1771812 | 2/1972 | Fed. Rep. of Germany . | |
| 2337798 | 2/1974 | Fed. Rep. of Germany . | |
| 2436783 | 2/1975 | Fed. Rep. of Germany . | |
| 2458660 | 6/1975 | Fed. Rep. of Germany . | |
| 2642350 | 3/1978 | Fed. Rep. of Germany . | |
| 2230794 | 12/1974 | France . | |
| 54-56847 | 8/1979 | Japan | 156/240 |
| 0055890 | 4/1980 | Japan | 101/470 |
| 0162347 | 9/1983 | Japan | 101/470 |
| 1517832 | 7/1978 | United Kingdom . | |

OTHER PUBLICATIONS

Wiliam L. Goffe, Radiant Thermal Biasing for Laser Induced Thermal Marking, May/Jun. 1977, Xerox Disclosure Journal, vol. 2, No. 3, p. 35.

Fuhr, Die Stralungstrocknung von Grundierungen und Lacken, Sonderdruck aus defazet Deutsche Farben – Zeitshrift, Jul. 1977, p. 257.

Rosenberg, Oberflaechenbeschichtungen haerten mit Elektronenstrahlung, Maschinenmarkt, 1978, p. 64.

*Primary Examiner*—J. Reed Fisher

*Attorney, Agent, or Firm*—Fred A. Keire

[57] ABSTRACT

An article having a substrate with a synthetic resin surface that has an affinity for printing inks is printed with a laser-induced hot print method. A transfer medium, printed on a face side with an image formed of sublimable dyes is faced against the synthetic resin surface, and a laser beam is made to impinge upon the unprinted back of the transfer medium. The laser beam is of sufficient intensity to cause the dyes to sublimate and penetrate at least partially into the synthetic resin surface of the substrate.

13 Claims, 4 Drawing Figures

PROCESS FOR PRINTING A SUBSTRATE BY THE HOT-TRANSFER PRINTING METHOD

This application is a continuation of application Ser. No. 759,509, filed July 26, 1985, now abandoned, which is a continuation of abandoned prior application Ser. No. 591,032 filed Mar. 19, 1984.

The invention relates to a process for printing a substrate having a synthetic-resin surface which has affinity for printing inks by the hot-transfer printing method by laying a transfer medium printed with dyes which are sublimable under the conditions of the process on the synthetic-resin surface and transferring the dyes into the synthetic-resin surface.

From published German patent applications DOS Nos. 1,771,812, 2,337,798, 2,436,783 and 2,458,660, for example, it is known to print textiles by the so-called hot-transfer printing method, in which transfer media consisting in particular of paper or aluminum foil are printed with sublimable dyes by the use of binders and the transfer media so printed are used to print the fabrics. The transfer media are laid by their printed side onto the fabrics to be printed and are then heated to about 160° to 220° C. on their unprinted side to sublime the dyes onto the fabric. When the latter is a cotton fabric, special steps are taken, according to said publications, to fix the dyes in the cotton.

From published German patent application DOS No. 2,642,350, it is further known to print heat-resistant sheet-like articles which per se do not accept sublimable dyes, for example, wood, metals, certain synthetic resins, glass, ceramics, plastic products or the like, by the hot-transfer method by providing such substrates either before transfer printing or simultaneously with it with a surface layer of a thermoplastic resin which bonds to the surface of the substrate and accepts the sublimable dyes. Similar processes are known from French Pat. No. 2,230,794 and from British Pat. No. 1,517,832, in which the substrate is coated with an epoxy resin or a cured unsaturated polyester resin. According to published European patent application No. 14,901, the substrate is coated with a crosslinked thermosetting resin from the group of phenolic resins, amino resins, polyesters, polyphenylene sulfide resins, silicone resins, acrylate resins, polyethylene sulfide resins and/or unsaturated polyester resins, and high-molecular-weight disperse dyes with molecular weights ranging from 340 to 1000 are used as sublimable dyes.

Characteristic of all these prior-art processes is that the transfer of the dyes by sublimation onto and into the surface of the substrate is effected by means of radiation of heat supplied by an external source. This is a drawback in that costly and bulky heating installations such as tunnel kilns or the like are required, especially when the process is to be carried out as a continuous process. The residence times of the transfer medium on the substrate are relatively long, and high transfer-printing speeds therefore cannot be attained in continuous operation.

The object of the invention is to make it possible to carry out the hot-transfer printing method without the use of heat radiation and with minimal residence times of the transfer medium on the substrate.

Surprisingly, it has been found that the transfer of sublimable dyes into the synthetic-resin coating of a substrate can be accomplished also with electromagnetic waves. Short residence times then are sufficient, and the hot-transfer printing method thus can be carried out as a continuous process at high production speeds.

In accordance with the invention, the process described at the outset is characterized in that the unprinted back of the transfer medium is treated with a laser beam of sufficient intensity for the dyes to penetrate at least partially into the synthetic-resin coating of the substrate. Preferably a laser beam of such intensity is used and the treatment is carried out for such a length of time that the transfer medium is heated to a temperature which, though below the flash point or decomposition point, is as close to it as possible.

This process substantially reduces the equipment and space needed for hot-transfer printing, especially when it is carried out on a continuous basis at high production speed, which otherwise would require tunnel kilns or other bulky installations for heating the rapidly advancing substrate to the requisite temperature. Even when in the process of the invention preheating is employed to support the action of the laser beam, the equipment needed therefor is far less costly than the preheating installations required up to now.

When in the prior-art processes the back of the transfer medium alone is heated and there is no preheating of the substrate, prolonged heating is required, and this rules out high production speeds. In contrast to such processes, the process of the invention offers the advantage that transfer printing can be carried out at high production speeds in continuous operation.

While the process in accordance with the invention requires no preheating, the nature of the substrate surface may be such that before being exposed to the laser beam it is advantageously preheated to a temperature below the sublimation temperature of the dyes to facilitate the penetration of the subliming dye molecules into the surface layer of the substrate. Such preheating can readily be accomplished by means of infrared lamps, for example.

The laser beam which impinges with high intensity on the dyes of the printing on the transfer medium and penetrates the latter from the back induces thermal agitation in the dye molecules, and this suffices to cause them instantaneously to sublime onto the surface of the substrate. Since the laser beam simultaneously sets the surface layer of the substrate, formed of an organic synthetic resin, into molecular motion without softening it to the point where it would stick to the transfer medium, the dye molecules do not remain on the surface of the substrate but penetrate into the synthetic-resin surface layer of the substrate, in which they are then anchored in an abrasion-resistant manner.

These events take place very rapidly; and, as mentioned earlier, the penetration of the dye molecules into the substrate surface may be facilitated by preheating it so that the residence times of the transfer medium on the substrate surface can be held to a minimum. Broadly, the residence time will range from 0.001 to 10 seconds, and it preferably ranges from 0.001 to 1 second, and more particularly from 0.01 to 0.1 second.

Now when reference is made in connection with the invention to substrates with a synthetic-resin surface, these may be articles made entirely of a synthetic resin, for example, polymethacrylate, in which case the dyes penetrate into the surface region. However, the substrates may also be formed of any other material, such as metal, wood, glass, porcelain, ceramic or the like which is provided with a surface coating of a synthetic resin that has affinity for the printing inks. Examples are steel plates, household articles made of steel or aluminum, aluminum beverage cans, ceramic tile, particle board, plywood, and even nonwoven fabrics and woven or knitted fabrics, natural stone, and molded foamed-plastic articles. Moreover, the process readily lends itself to the printing of continuous-cast steel.

Surface coating of such substrates can be carried out with thermoplastic resins commonly used for this purpose or with crosslinking thermosetting resins. Examples of both classes of plastics will be found in the patent publications cited.

Examples of thermoplasts for surface coating are polyacrylonitrile, polyacrylates, polyesters, polyurethanes, cellulose derivatives, epoxy resins, polyamides, etc. Among these, nonlinear polyurethanes and polyesters are preferred.

Examples of crosslinking thermosets are epoxy resins, phenolic resins, amino resins, crosslinking polyesters, polyphenylene sulfide resins, silicone resins, crosslinked acrylate resins, alkyd resins, polyethylene sulfide resins, polyether sulfone resins and crosslinked unsaturated polyester resins.

Crosslinking of the thermosetting resins can be effected in various ways. Crosslinking agents are used which are capable of transforming the linear molecular chains of the precursor of the crosslinking thermoplastic which is first deposited on the substrate, and which has reactive centers, into networks with a three-dimensional structure by formation of intermolecular bridges. The crosslinking agents may either be incorporated themselves into the network as intermolecular bridges or activate direct combination of reactive centers from chain to chain.

The network may be formed by polyaddition or polycondensation reactions, for example, or by free-radial, peroxide-catalyzed polymerization.

Curing of the thermosetting resins may be influenced by adding accelerators such as cobalt octanoate, dimethylaniline or peroxides.

A particularly well-suited group of thermosets is that of the silicone resins, especially silicone resins with methyl, ethyl and phenyl substituents, for example, methylphenyl silicone resins. Depending on the substituents, they are water-repellent and difficultly flammable, exhibit good dimensional stability at high temperatures, and possess good surface hardness in addition to excellent affinity for the disperse dyes to be used. Also well suited are silicone polyester resins.

Another approach to the crosslinking of thermosetting resins is the use of crosslinking radiation, such as infrared and ultraviolet radiation, or ionizing radiation with gamma rays, x-rays or electron beams. This method is known per se and is described in "defazet" Deutsche Farben-Zeitschrift 1977, pp. 257–264, and in Maschinenmarkt, Würzburg, 84 (1978), 64, pp. 1249–1252. The advantages of this crosslinking method are very high production speed and crosslinking uniformity. Curing or crosslinking occurs at room temperature. Both pigmented and nonpigmented systems may be used.

In the electron-beam technique, the wet coating film is covered with a protective gas. Good passivation in conjunction with high ionization density produced by exposure to the electron beam results in a high degree of crosslinking of the molecules of the thermosetting resin. After a curing time of about 0.2 seconds, the products can be immediately stacked and processed further. This technology makes it possible to obtain greater surface hardness, increased abrasion resistance, higher density, improved resistance to chemicals, good affinity for dyes, reduced flammability and high production speeds.

Particularly well suited for use with this radiation method of crosslinking are unsaturated acrylate resins and unsaturated polyester resins, as described, for example, in the above article in "defazet", whose content is made part hereof.

In carrying out the invention, the substrate is usually first provided at least on the surface to be printed with a precursor of the crosslinking thermosetting resin. This may be done by dip coating, brush coating, spray coating, knife coating or roll coating with a solution or dispersion of the precursor of the thermoset. However, the coating may also be applied without the use of a solvent by being extruded, laminated or pulverized onto the substrate.

Certain substances such as pigments may be added to the precursor of the thermosetting resin. Or an intermediate layer adapted to produce color effects or to improve the surface quality, for example, a pigmented interlayer, may be applied to the substrate under the precursor coating.

The dyes used are advantageously disperse dyes which will sublime to the extent of more than 80 percent only above 200° C., and more particularly above 220° C. The disperse dyes used in accordance with the invention advantageously sublime to the extent of more than 90 percent above 250° C., and preferably above 300° C., and more particularly above 350° C. However, equipment considerations make it advisable to choose dyes which sublime below 500° C., and preferably below 400° C.

While it has not been possible up to now to use dyes containing strongly water-solubilizing ionic groups such as $—SO_3H$ or —COOH in hot-transfer printing, such dyes can be used successfully in the process of the invention. Moreover, the number of nonionic polar groups, such as $—NO_2$, —CN, $—SO_2R$ (R=alkyl), —OH, $—NH_2$ or —NHR (R=alkyl), may be greater than in the dyes usable up to now. In addition to alkyl-substituted amino groups, for example, isobutyl amino groups, the dyes may contain linear groups, which up to now have been avoided in hot-transfer printing. In the case of azo dyes, cyano groups are preferable to nitro groups, and fluorine atoms are better suited than chlorine atoms. Trimethylsilyl groups may increase the vapor pressure in azo dyes.

Certain anthraquinone, monoazo and azomethine dyes form a preferred group of disperse dyes used in accordance with the invention; however, the process of the invention is not limited to these groups of dyes.

Particularly preferred are anthraquinone, monoazo and azomethine dyes in which a great many amino, alkoxy, oxalkyl, nitro, halogen and cyano groups are attached to the dye molecules. These groups of dyes are defined in the Colour Index, vol. 1, pp. 1655–1742.

In many cases it may be advisable to apply, prior to the surface coating of the substrate, a primer which may be formed of a thermoplastic resin with titanium dioxide or zinc oxide and is known as varnish. Thermoplasts suitable for this use are, for example, polyacrylonitrile, polyesters, polyurethanes, cellulose derivatives such as cellulose 21/2 acetate, cellulose triacetate, nitrocellulose, polyamides such as polycaprolactam, polyundecaneamide or polyhexamethylene adipamide, and especially nonlinear polyurethanes and polyesters.

The transfer medium usually is paper, and particularly a paper which has no plastic coating. The paper may be silicone- or Teflon-treated. However, plastic foils or other foil materials may also be used as transfer media. The transfer media may be printed by any of the known printing processes adapted to three- or four-color process printing, such as rotogravure and offset lithography. In this way, optimum registration and picture quality with several thousand different hues can be obtained.

In hot-transfer printing, the patterns to be transferred usually are fairly large-area patterns, and the diameter of the laser beam, which may range from 16 to 18 mm, therefore will not be sufficiently large to treat the entire area which is to be printed. For this reason, it is advisable to fan out the laser beam to a diameter greater than its original 16- to 18-mm diameter and/or to cause the laser beam to sweep over the transfer-medium surface to be covered.

Such fan-out to a larger diameter can be accomplished conventionally by means of optical lenses. In this way, the laser beam can be expanded to a diameter of from 15 to 20 cm to permit the entire surface of, say, a rotating aluminum beverage can to be treated without the laser beam being deflected.

Causing the laser beam to sweep over large areas, as in the printing of metal plates, can be accomplished by deflecting the laser beam by means of a pivoting mirror known as a sweep generator. With a frequency of 500 Hz, such a mirror is able to cover an area with a diameter of 50 cm when spaced 1 meter from the substrate, an area with a diameter of 100 cm when spaced 2 m from the substrate, and an area with a diameter of 200 cm when spaced 4 m from the substrate. The methods of laser-beam fan-out and deflection may, of course, be combined.

Especially when a fixed, that is, undeflected laser beam is employed, it is advisable to use a laser beam with minimal differences in intensity over its cross-sectional area as otherwise it is likely that the transfer medium will undergo grossly nonuniform heating, with the result that it may burn in some areas while not being heated sufficiently in in other areas for the dyes to be adequately transferred and for the surface layer of the substrate to be rendered receptive to the dyes. This is not quite so important when the deflection technique is employed since their intensity differences over the cross-sectional area of the laser beam are equalized by the rapidly changing site of impingement of the laser beam on the transfer medium.

Laser beams of different origins, different intensities and different wavelengths may be used. The wavelength will generally range from 500 to 50,000 nm, and preferably from 1,000 to 20,000 nm, more preferably from 2,500 to 15,000 nm, and more particularly from 8,000 to 12,000 nm. For example, a laser beam from a carbon dioxide gas laser with a wavelength of 10,600 nm may be employed to advantage.

The intensity or continuous power output of the laser beam will usually range from 50 to 15,000 watts, and preferably from 100 to 1,000 watts, more preferably from 200 to 800 watts, and more particularly from 300 to 600 watts. For example, a laser beam with a power output ranging from 400 to 500 watts may be used to advantage.

The laser beams used in accordance with the invention may emanate from a wide variety of lasers, such as solid-state lasers, semiconductor lasers, dye lasers, gas lasers, liquid lasers and chemical lasers. The use of laser beams from gas lasers, and preferably from carbon dioxide lasers, is preferred.

The invention will now be described in greater detail with reference to the accompanying drawing illustrating four embodiments, wherein.

Figure 1:
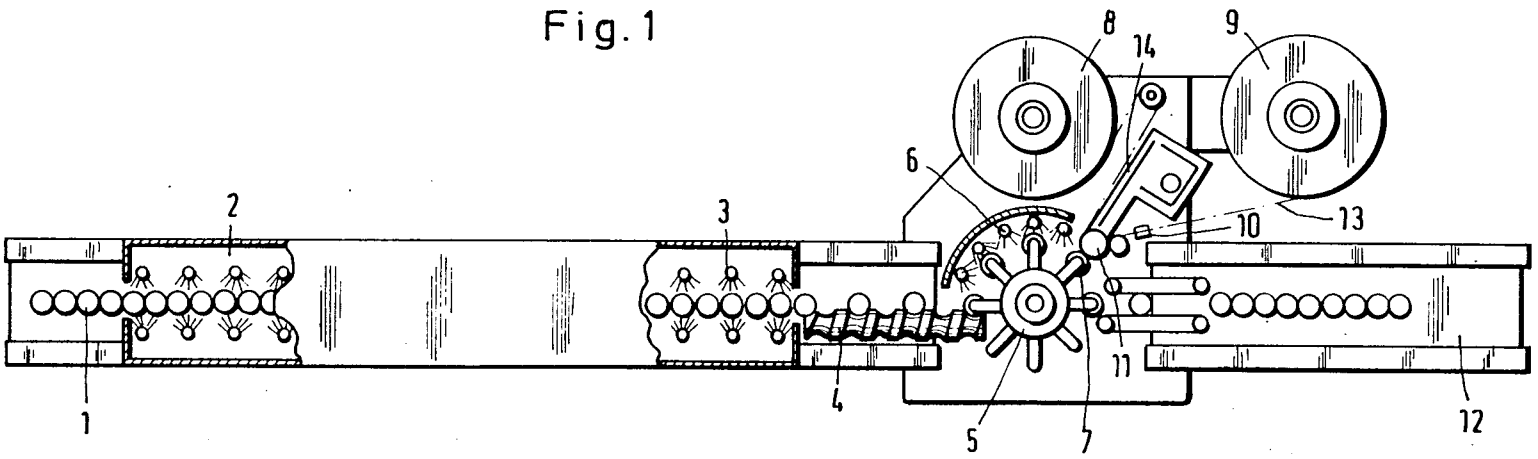
FIG. 1 is a top plan view of an apparatus for carrying out the process of the invention in the printing of cylindrical cans.

In the apparatus shown in FIG. 1, the cans 1 are conveyed through a preheating cabinet 2 with infrared lamps 3. They are then picked up by a feed screw 4 which transfers them to a feed starwheel 5 (incremental-drive-controlled), the cans then being first carried clockwise past further infrared lamps 6 and being preheated further. In position 7, a feed cylinder 11 then brings them into contact with the printed transfer medium 13 which unwinds from a supply reel 8 and is wound onto a takeup reel 9, this being controlled by a photocell 10. In position 7, the transfer medium is exposed, through a laser sublimator 14, to a laser beam which transfers the dyes into the synthetic-resin coating of the cans.

After this transfer-printing operation, the cans are moved by means of the feed starwheel 5 to a discharge station 12.

Figure 2:
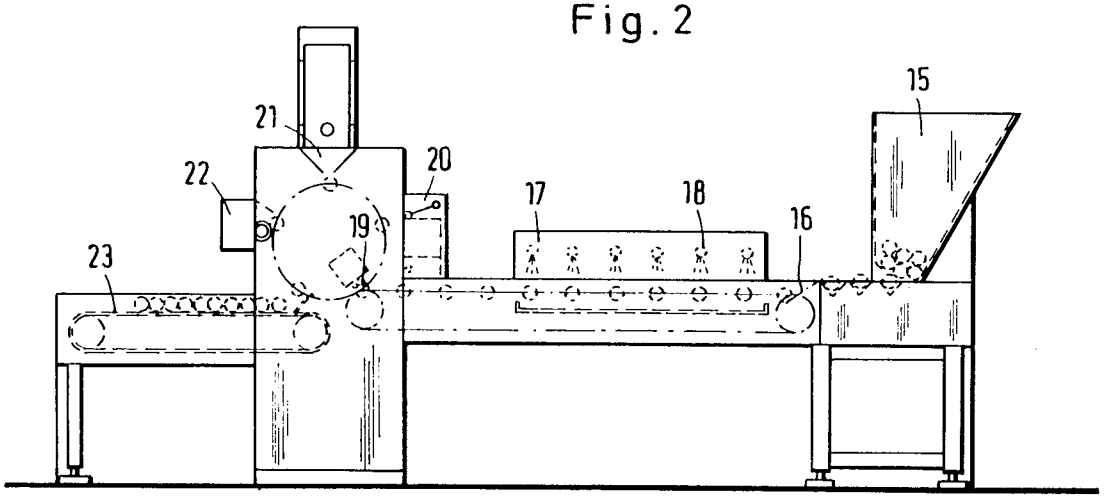
FIG. 2 is a side-elevational view of another apparatus for carrying out the process of the invention, likewise for the printing of cans.

In the apparatus shown in FIG. 2, tin cans drop from a feed hopper 15 onto a conveyor 16 and are carried through a preheating cabinet 17 with infrared lamps 18. The cans are electrostatically charged and through a Maltese cross 19, indicated schematically, are carried past a sheet-feeding station 20 where a sheet of the printed transfer medium is electrostatically adhered to each can. Through the Maltese cross, the can is then carried past the laser 21, which transfers the dyes into the synthetic-resin surface coating of the tin can. The latter then moves through a sheet-removal station 22 where the electrostatic charge is neutralized and the transfer medium is removed from the can by suction. The can finally drops onto a discharge means 23 and from there leaves the apparatus.

Figure 3:
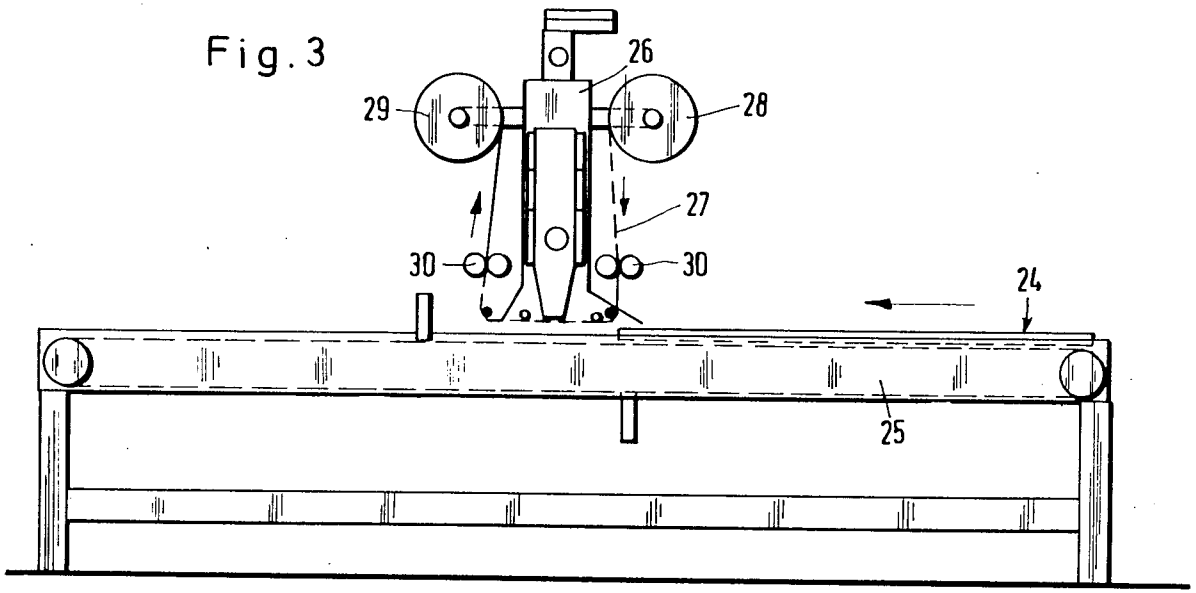
FIG. 3 is a side-elevational view of a further apparatus for carrying out the process of the invention in the printing of a flat article made of polymethacrylate, for example.

In the apparatus shown in FIG. 3, a flat article 24 made of polymethacrylate, for example, is placed on a time-controlled conveyor belt 25 which moves it forward in timed motion. The flat article thus moves past a laser sublimator 26, and a transfer medium 27 is simultaneously applied to the flat article 24. The transfer medium 27, printed on its underside, is unwound from a reel 28 by means of a synchronized feed roll 30 and after the transfer-printing operation is wound onto a reel 29.

Figure 4:
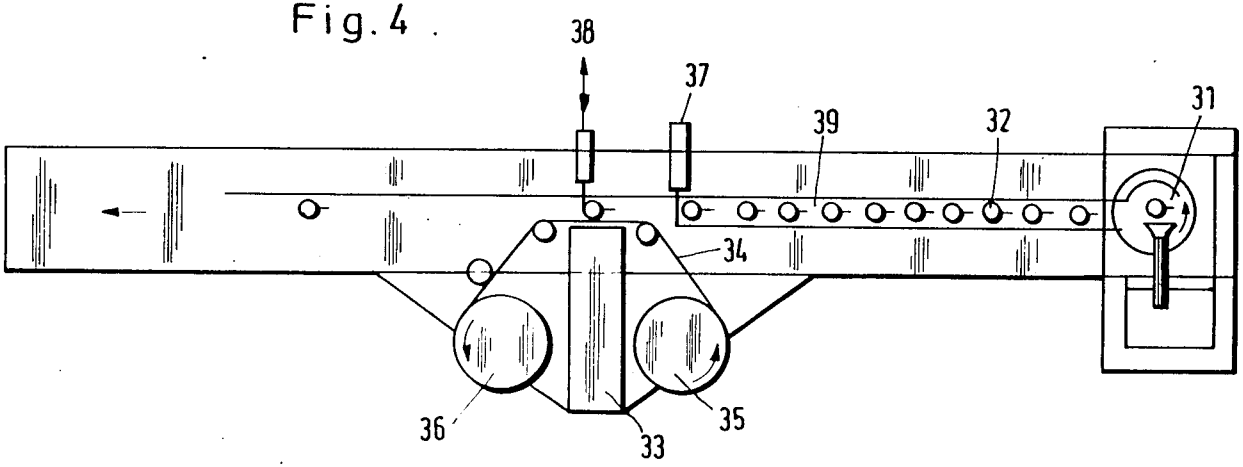
FIG. 4 is a side-elevational view of still another apparatus for carrying out the process of the invention in the printing of glass bottles.

In the apparatus shown in FIG. 4, glass bottles are coated in a coating station 31 with a synthetic resin having affinity for dyes. By means of a conveyor 39, the glass bottles 32 so surface-coated reach, with the aid of a clock generator 37, a positioning unit 38 where they make contact with a strip of labels 34 which is unwound from a reel 35 and after transfer printing is wound onto a reel 36. In the position in which the label strip is in contact with the bottle, a laser beam from a laser sublimator 33 impinges on the back of the label strip, the label thus being transfer-printed onto the glass bottle.

The examples which follow will serve to illustrate the invention further.

EXAMPLE 1

Seamless beverage cans drawn from circular aluminum blanks by the deep-flow method are conventionally provided with an internal coating of lacquer and coated externally with an epoxy resin system which has specific affinity for dyes, and fully polymerized by the use of heat. Their further treatment is carried out in the type of apparatus shown in FIG. 1.

The pretreated beverage cans are carried by conventional conveyor belts to a preheating cabinet of the laser sublimation apparatus and through a screw are brought into synchronism with the transfer-printing system.

The beverage cans are then transferred to a Maltese cross, preheated by infrared lamps to 200° C., and fed to the point where the rotating can comes into contact with continuous transfer label paper.

In the contact zone, a laser beam expanded to the width of the can impinges on the transfer label paper, and sublimation of the dye occurs in less than one second. After transfer printing, the transfer label paper is wound onto a reel for later recycling, while the transfer-printed beverage cans are routed to a palletizing mechanism like standard cans.

EXAMPLE 2

Seamless tin cans drawn in several passes by the deep-flow method are conventionally provided with an internal coating of lacquer and coated externally with an acrylate-based coating system which has affinity for dyes. Their further treatment is carried out in the type of apparatus shown in FIG. 2 of the drawing. The cans ready for transfer printing are carried by way of a proportioning device (storage) into the intermittently operating laser sublimation apparatus and heated to about 200° C. by infrared lamps in a preheating cabinet.

The beverage can is then electrostatically charged, moved past the sheet-feeding unit by means of a Maltese cross, and labeled.

In the next time-controlled station, a 500-w laser beam expanded to the width of the can impinges on the rotating can. Transfer printing takes place in less than one second. The electrostatic field is then caused to collapse by ionization, and the transfer-printing paper is drawn by a vacuum to the sheet-removal station.

The transfer-printed beverage cans are routed to a pelletizing mechanism like standard cans.

EXAMPLE 3

The new laser sublimation process makes it possible to print cast or extruded polymethacrylate by the hot-transfer printing method and then to form it under vacuum or by the use of compressed air in the rubber-elastic state. Transfer printing is carried out in an apparatus of the type shown in FIG. 3 of the drawing.

The polymethacrylate plates are carried by a synchronized time-controlled conveyor belt to the laser sublimation apparatus. In a transfer-printing zone, they are brought into contact with a synchronously moving continuous paper strip on which designs have been printed with disperse dyes by the rotogravure process.

The transfer-printing zone is swept by a laser beam which through special lenses and an electromagnetic system is set into discrete oscillations. The power should not be less than 500 w. The feed is in synchronism with the laser transfer-printing speed. Following transfer printing, the transfer design paper is removed and later recycled.

EXAMPLE 4

Glass beverage bottles are provided in a coating station of an apparatus of the type shown in FIG. 4 of the drawing over all or part of their surface with a coating system having affinity for dyes by the use of an adhesion promoter. The glass bottles then pass through a heated oven for polymerization of the coating layer and through a time-controlled system are brought into contact with a continuous label strip which is printed with disperse dyes.

The paper is exposed to the laser beam at the points where it is in contact with the rotating can, hot-transfer printing being completed within one second.

Following the printing operation, the continuous transfer paper is wound onto a reel for recycling, and the decorated glass bottle is carried to a packaging station.

After a minor changeover, the apparatus is capable of decorating also beer glasses, for example, or glasses for other beverages.

We claim:

1. In a process for printing a substrate having a synthetic-resin surface which has an affinity for printing inks, said printing being a laser-induced hot transfer printing method, the process comprising the steps of laying onto the synthetic resin surface a transfer medium printed on a face surface with a dye image formed of dyes which are sublimable under the conditins of the process and transferrable into said synthetic resin, with the printed face surface facing the synthetic resin surface, transferring the dyes into the synthetic resin surface by first heating and then laser-light sublimating said dyes, including preheating said surface of the substrate to a temperature below the sublimation temperature of the dyes, and impinging a laser beam substantially uniformly for a treatment time of 0.01 second to 0.1 second over the unprinted back of the preheated transfer medium, the laser beam being of a wavelength in the range 2500 to 15,000 nm and of an intensity sufficient to cause the dyes to sublime of more than 80 percent above 220° C. and penetrate sufficiently substantially into the synthetic resin of the substrate in an abrasion resistant manner.

2. A process according to claim 1, wherein said preheating of the surface of the substrate is carried out with infrared radiation.

3. A process according to claim 1, further comprising fanning the laser beam out to a diameter greater than its original diameter.

4. A process according to claim 1, wherein a laser beam of a power output ranging from 50 to 15,000 watts is used.

5. A process according to claim 1, wherein said laser beam has minimal intensity differences over its cross-sectional area.

6. A process according to claim 1, wherein said laser beam has a wavelength ranging from 8,000 to 12,000 nm.

7. A process according to claim 1, wherein the area of the transfer medium to be exposed to the laser beam is swept over by deflecting the laser beam through a pivoting mirror.

8. A process according to claim 1, wherein the laser beam used is that of a gas laser.

9. A process according to claim 1, wherein the laser beam is of such intensity, and impinges from such a length of time, that the dyes on the transfer medium are heated to a temperature just below their flash point or decomposition point.

10. A process to claim 1, further comprising sweeping the laser beam over the area of the transfer medium which is to be covered.

11. A process according to claim 4, wherein said power ranges from 100 to 1000 watts.

12. A process according to claim 4, wherein said power ranges from 200 to 800 watts.

13. A process according to claim 4, wherein said power ranges from 300 to 600 watts.

* * * * *